US006026622A

United States Patent [19]

Schmid

[11] Patent Number: 6,026,622

[45] Date of Patent: Feb. 22, 2000

[54] PREDETERMINED CRACK-JOINT

[75] Inventor: Rene P. Schmid, Oberweningen, Switzerland

[73] Assignee: Rascor Spezialbau GmbH, Stuttgart, Germany

[21] Appl. No.: 08/765,301

[22] PCT Filed: Jun. 23, 1995

[86] PCT No.: PCT/EP95/02449

§ 371 Date: Aug. 27, 1997

§ 102(e) Date: Aug. 27, 1997

[87] PCT Pub. No.: WO96/00822

PCT Pub. Date: Jan. 11, 1996

[51] Int. Cl.[7] ..... E04B 1/682

[52] U.S. Cl. ..... 52/396.02; 52/731.7

[58] Field of Search ..... 52/514, 731.7, 52/573.1, 396.08, 396.09, 396.04, 396.02

[56] References Cited

U.S. PATENT DOCUMENTS

| | | | |
|---|---|---|---|
| 3,903,587 | 9/1975 | Borardi | 52/396.02 X |
| 4,128,358 | 12/1978 | Compton | 52/396.04 X |
| 4,964,256 | 10/1990 | McCracken | 52/731.7 X |
| 5,339,590 | 8/1994 | Kangas | 52/396.02 |
| 5,473,848 | 12/1995 | Kangas | 52/396.02 |

FOREIGN PATENT DOCUMENTS

| | | | |
|---|---|---|---|
| 2177132 | 1/1987 | United Kingdom | 52/731.7 |

*Primary Examiner*—Creighton Smith
*Attorney, Agent, or Firm*—Harness, Dickey & Pierce, PLC

[57] ABSTRACT

Contraction joint rail for fitting in a wall (4) to be concreted and the use of such a rail which consists of a strip-like bar (1) with a device fitted to it forming an injection channel (2) extending over the length of the bar (1). The bar (1) may consist of a thin-walled plastic component, sheet zinc or the like. The device forming the injection channel (2) may be a foam strip (12) applied to the bar (1). The bar (1) may be fitted on both sides with a device forming an injection channel (2) and/or have perforations (5) permitting the penetration of a sealing material. The contraction joint rail of the invention is applied to an area of the wall (4) to be concreted and extends over the entire height of the wall (4), whereby after the wall (4) has been concreted, sealing material is sprayed into the injection channel (2) thus formed.

21 Claims, 4 Drawing Sheets

PREDETERMINED CRACK-JOINT

Figure 1:
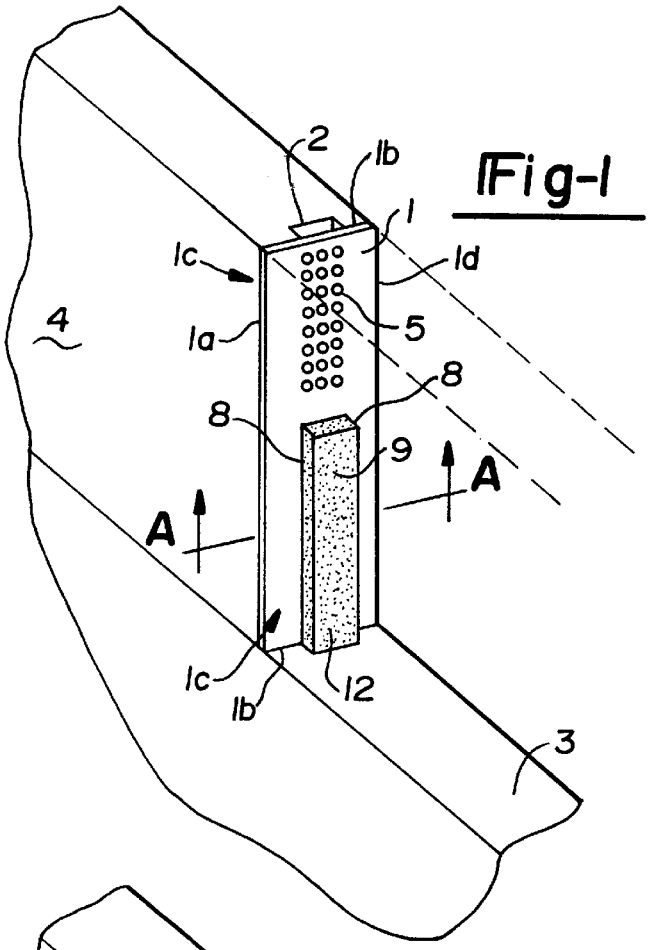

The invention relates to a predetermined crack joint rail.

When concreting elongated continuous wall sections, cracks occur due to the shrinkage of the concrete, which cracks can result in leakage of the wall. Therefore, in particular in the case of walls against which water stands, at particular points predetermined cracks are produced by introducing elements, which reduce the wall cross-section. These cracks are sealed off by crack producing elements, so that the tightness of the wall is ensured.

In conventional manner joint sealing tubes are used for producing such predetermined crack joints, which tubes consist of a tubular shaped joint strip and a hard PVC stiffening tube.

The cross-section of the wall is positively weakened by mounting the joint sealing tube in the center of a wall and by simultaneous application of triangular strips on the inner and outside. Thereby the shrinkage cracks are localized and are sealed off by way of the joint strip.

In doing so the tubular shaped joint strip is welded to a joint strip extending horizontally in the transition of the floor slab to the wall so that a water impervious elastic layer is created.

In this type of joint sealing tube it is disadvantageous that the joint sealing tube is not placed on the surface of the floor slab on which the wall is concreted because otherwise the water can penetrate in longitudinal direction of the joint sealing space.

Furthermore, predetermined crack joint rails are known which are constituted by plate shaped hollow or solid elements with several chambers extending in longitudinal direction. These rails have a particular thickness in order to take up a swelling strip in a groove along a longitudinal narrow side. The swelling strip is applied also at the narrow side of the rail resting on the floor in order to create reliably a seal in the joint between the floor slab and the wall to be concreted. The swelling sealing strip provided at the layer narrow side of the rail is to be joined furthermore in longitudinal direction of the joint between the floor slab and the swelling sealing strips extending to the wall to be concreted whereby a conventional seal of the overall joint strip region is achieved by means of the swelling strip.

The rails with hollow chambers used for this purpose are made of plastics material. Furthermore, either very thick swelling strips are to be used in order to ensure a reliable sealing, which in turn increases the cost of the predetermined crack joint rail, or only a limited sealing effect is allowed, which is not sufficient at localized high water pressures. A subsequent sealing off of such predetermined crack joints sealed off with swelling strips can be executed either only from the outside or it is extremely costly if subsequent sealing is to be performed at the rail. The concrete wall then has to be broken open or it can be sealed off locally by way of an outwardly applied but very expensive point injection process.

The swelling strip used thereby swells under water influence. The swelling agent is a hydrophilic mass, which is embedded in a carrier material, mostly chloroprene rubber. The carrier material in particular has the object to provide stability and elasticity to the swelling agent. The hydrophilic (water sucking) components absorb water molecules and thereby increase its volume for 1.5 to about 4 times. Thereby a pressure of up to 6.5 bar is created, which fills the surrounding hollow spaces and is supposed to make these spaces water impervious. When using such swelling agents care has to be taken that they do not expand suddenly but expand slowly over hours or days and consequently can only be used to a limited extent in regions alternating with wet and dry periods. A clear advantage of swelling agents, this being the reason why they are often applied, is in the possibility to seal off joints between different materials reliably, as for example concrete/plastics material, concrete/iron etc.

Furthermore, sealing arrangements for sealing a joint existing between two concrete sections are known, which form a channel through which an injection agent can be injected into the joint region under high pressure and seals it off.

In the CH-PS 600 077 a tube is described, which consists of a support body in the form of a coil spring, which is surrounded by a first, woven tube, which in turn is encased by an outer, net type porous tube. After mounting this sealing arrangement and concreting of the second concrete section, a sealing material is pressed into the tubular sealing arrangement, which should engage at the defective positions of the concrete. Such a tube involves an arrangement which is relatively complicated to produce.

In order to protect such porous tubes better against blocking by concrete slimes, it is suggested in DE 83 35 231 Ul to introduce a non-woven material between the support body in the form of a coil spring and the outer net-shaped tube, which is liquid pervious but impervious for fine concrete particles.

Finally from the DE 86 08 396 Ul a further sealing arrangement in the form of an injection tube is known, which, on the one hand, intends removing the disadvantages in positioning the tube by way of the tubular bodies and, on the other hand, suggests a predetermined crack position in longitudinal direction of the tubular body, by way of which the sealing material has to emerge into the concrete.

The construction of these tubes becomes more complicated and expensive with continuous development, whereby also their costs increase. Additionally there is the danger that these tubes are squeezed together during concreting so that the injection of injection material is made difficult.

Therefore a sealing arrangement is suggested in the EP 0 418 699 Al, which consists of a profile open in cross section, which is mounted with the free longitudinal edges of its side regions on a concrete surface so that a through-flow channel is formed for a sealing material between the profile and the concrete surface. The sealing material is introduced under high pressure into the throughflow channel and emerges between the free longitudinal edges of the profile and the concrete surface at defective positions of the concrete. A further sealing arrangement described therein consists of a body, which consists of a foam material or foam strip having through pores with rectangular cross-section, which is mounted on the concrete surface so that the through-flow channel for a sealing material is formed by the body itself, whereby the sealing material emerges out of the throughflow pores into the joint region.

Although the sealing arrangement does represent a considerable advance as compared to the conventional tubes, it is not intended for use in predetermined crack joints because a one sided open profile is to be applied on an already completed concrete surface of the floor slab for forming the injection channel. In the production of predetermined crack joints, however, the arrangement producing the predetermined crack joint is concreted on both sides so that such a profile open on one side would be filled with concrete.

In summary, the prior art, on the one hand contains elements for producing a predetermined crack joint, but which are all complicated and therefore expensive. If the elements for sealing are provided with swelling strips, they are subject to their generally known disadvantages. On the other hand there are injection procedures for joints between two concrete sections which do not have the disadvantages of the swelling strips but are not suitable for the use as arrangement for producing a predetermined crack joint.

Object of the invention is the creation of a simple, cost favourable arrangement for producing predetermined crack joints, which allows a reliable sealing of the predetermined crack joint, which sealing also can be performed subsequently.

The object is achieved by way of a predetermined crack joint rail with a characteristics of claim 1.

An arrangement is created in cost favorable and simple manner and type, which is suitable for producing a predetermined crack and which allows a subsequent sealing off by injection of a sealing material into the injection channel by providing a strip shaped rail slat with an arrangement forming an injection channel applied thereto, which extends along the overall length of the rail slat.

The predetermined crack joint rails in accordance with the invention can be premanufactured and be applied on the building site, whereby the arrangement forming the injection channel need not be assembled on the building site. Hereby the danger of a poor connection between the rail slat and the arrangement forming the injection channel is avoided and the problem of the creeping in of the injection channel is reliably prevented.

The invention can be performed simply only by applying a foam material strip of an open cell foam material at the substantially strip shaped rail slat, which is sufficient for producing an injection channel in the predetermined crack joint and is not pressed together into functional disability by the concrete present on the side. In surprisingly simple manner it is possible to provide an injection channel by way of an open foam strip, which is not protected against the adjacent concrete because the side pressure of the adjacent liquid concrete is reduced considerably by shrinkage during the curing procedure, because the concrete shrinks away from the predetermined crack joint.

Advantageous embodiments of the invention are evident from the description and the subsidiary claims.

Figure 2:
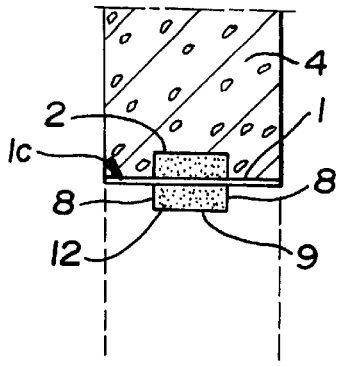
Figure 3:
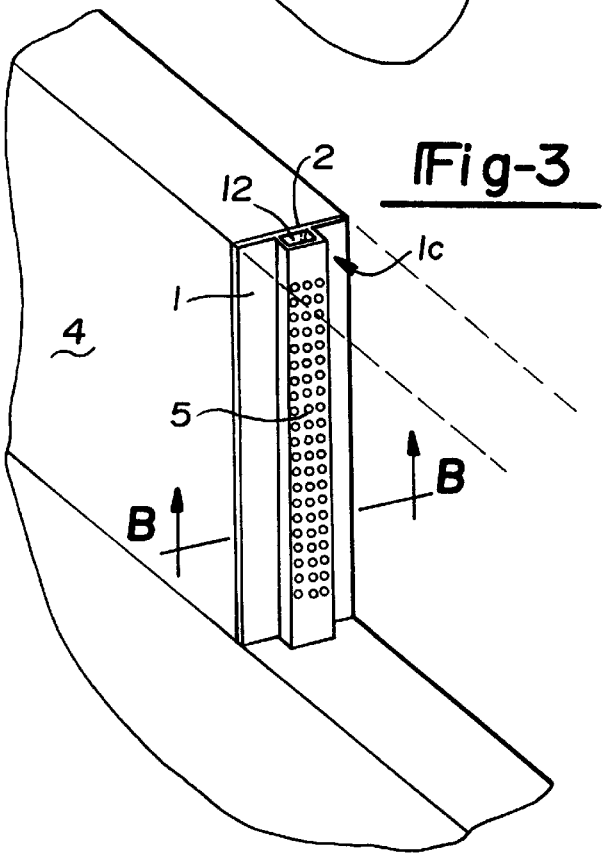
Figure 4:
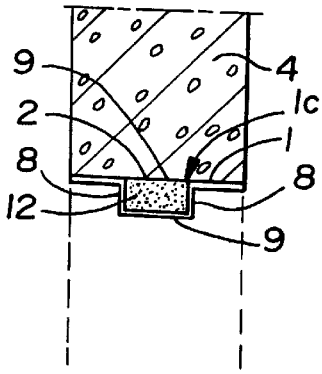
Figure 5:
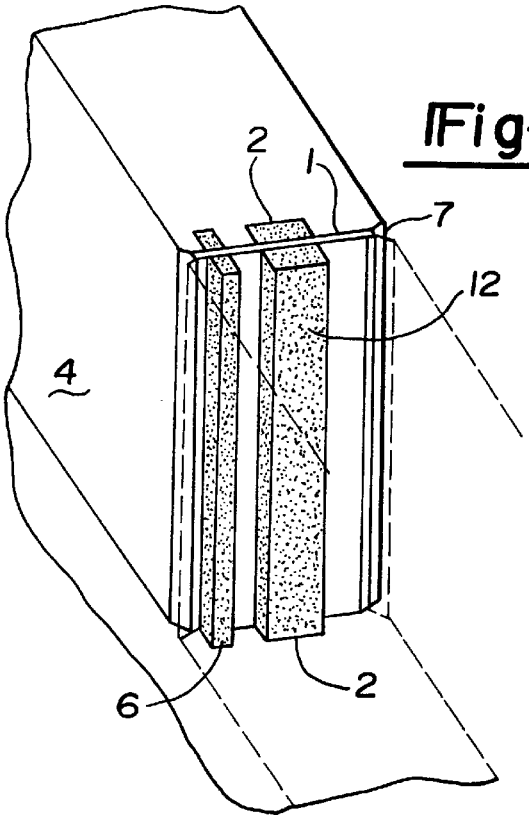
Figure 6:
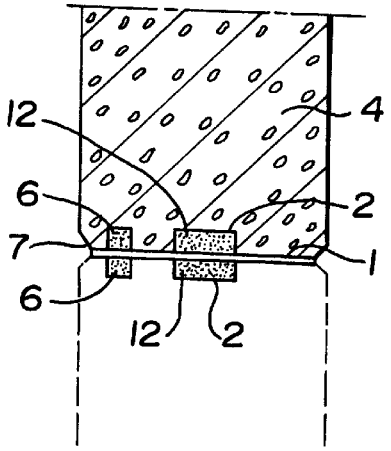
Figure 7:
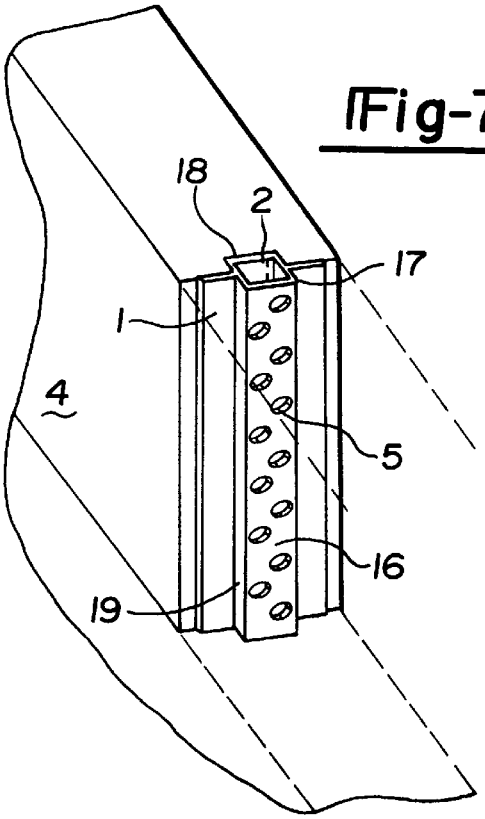
Figure 8:
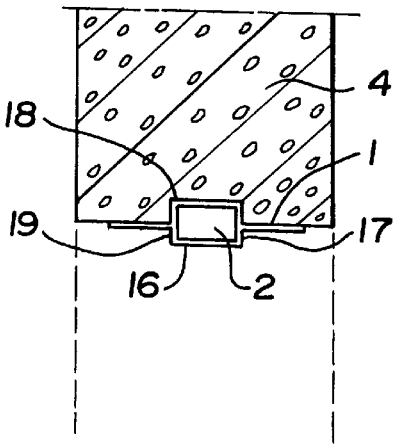
Figure 9:
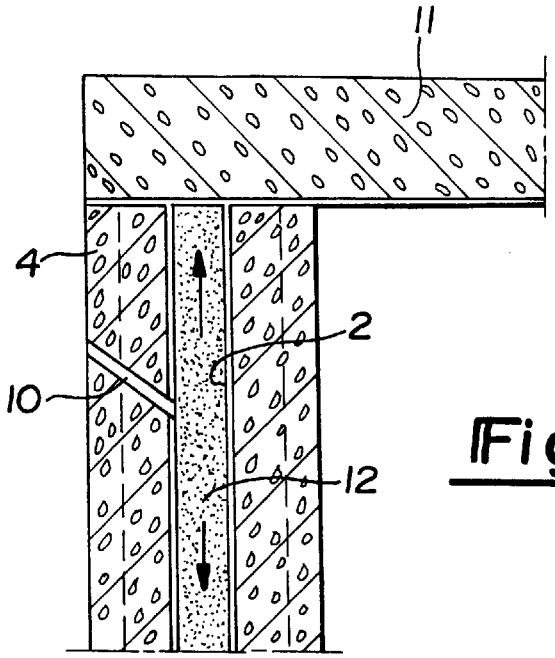
Figure 10:
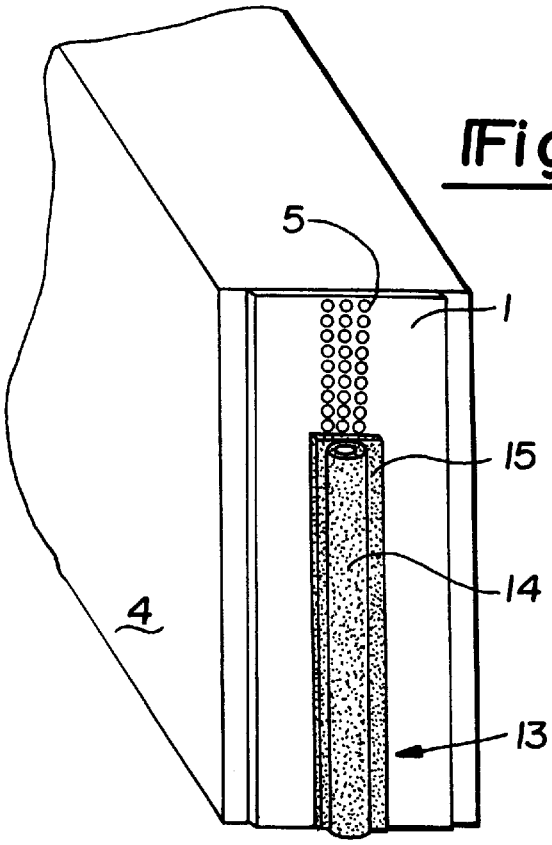
Figure 11:
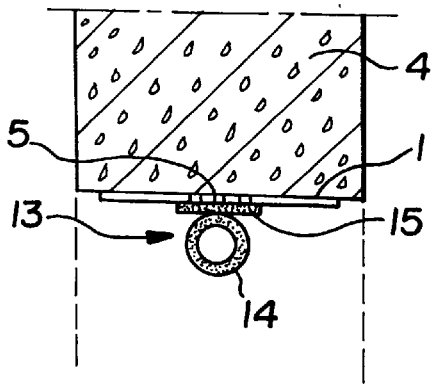

The invention is described in more detail by way of example with reference to the drawings. It is shown in:

FIG. 1 a first embodiment of the arrangement in accordance with the invention;

FIG. 2 the first embodiment of FIG. 1 in cross-section;

FIG. 3 a second embodiment of the arrangement in accordance with the invention;

FIG. 4 the second embodiment of FIG. 3 in cross-section;

FIG. 5 an embodiment with swelling strip;

FIG. 6 the embodiment of FIG. 5 in cross-section;

FIG. 7 an embodiment with hollow injection channel;

FIG. 8 the embodiment of FIG. 7 in cross-section;

FIG. 9 a bore for injection of the sealing material;

FIG. 10 an embodiment with injection tube;

FIG. 11 the embodiment of FIG. 10 in cross-section; and

Figure 12:
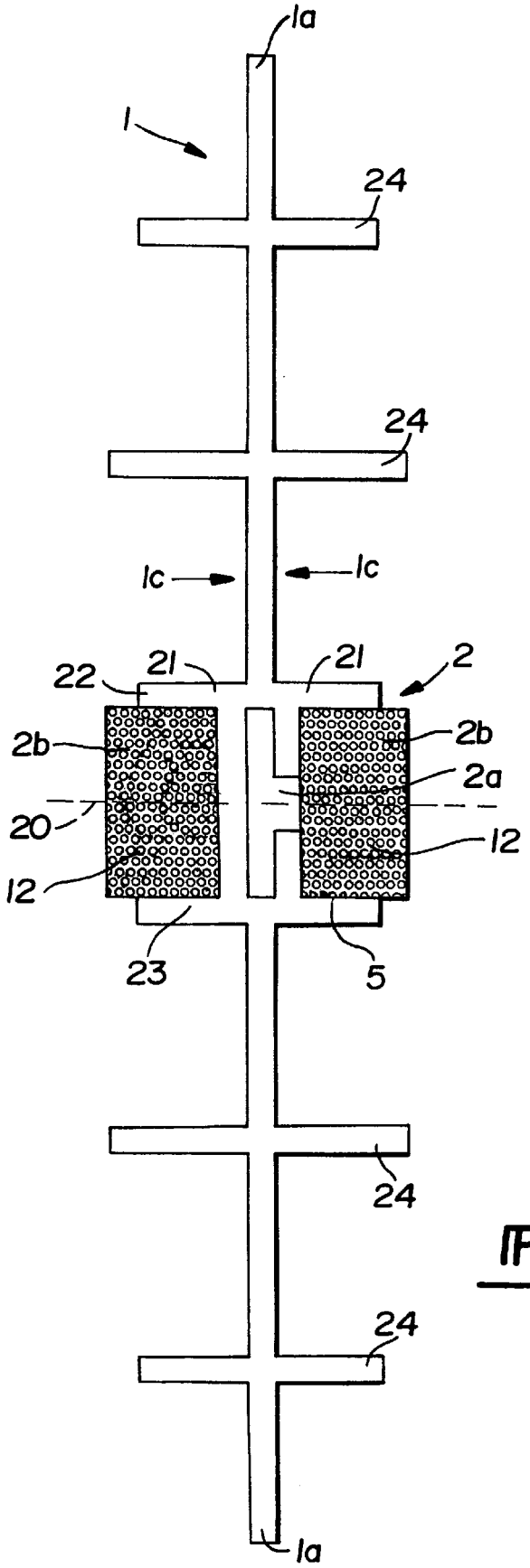

FIG. 12 a cross-section through a further embodiment of a predetermined crack joint rail in accordance with the invention.

The predetermined crack joint rail in accordance with the invention consists of a substantially strip-shaped rail slat 1 and an arrangement forming an injection channel applied thereto, which arrangement extends along the overall length of the rail slat 1.

The rail slat 1 preferably is formed of a type of metal sheet, that is it consists of a thin walled, flat material, which has a particular inherent stiffness, such as metal sheet. The strip-shaped rail slat 1 has two long side elongated edges 1*a,* an upper and a lower transverse edge 1*b* and two rail slat surfaces 1*c* limited by the edges 1*a,* 1*b*.

The arrangement forming the injection channel 2 can be a conventional injection channel or it can consist of a sealing arrangement with a profile, which is open in cross-section and is hood shaped, which arrangement is arranged to be seated on the rail slat surface 1*c* by way of its free longitudinal edges of its side regions. A foam strip 12 of an open cell or open pore foam material can be formed particularly advantageously as an arrangement for forming an injection channel 2.

The rail slat 1 preferably has a width which is somewhat smaller than the wall thickness of the wall to be concreted so that it can be concreted in at a distance of one to some centimeters from the wall outer surface. The cross-section also can be reduced in combination with triangular strips applied from the outside onto the wall surface. The length of the rail slat 1 should correspond approximately to the height of the wall so that the rail slat 1 can be erected, prior to concreting, on the floor section 3 of a floor slab and then extends up to the upper limit of the wail to be concreted.

The foam material 12 preferably has a somewhat rectangular cross-section in that its cross-sectional surface is selected such that the foam material is not pressed together by the abutting concrete so as to be impervious to injection material, and it should not be too large to keep the volume small, which is to be filled with the injection material. In the case of injection channels with a too large cross-section there is the additional danger that, in case of greater non-tightness, sufficient pressure for sealing cannot be built-up during injection of the sealing material.

The foam material 12 preferably is an open cell foam material, which consists of a stiff plastics material so that the foam material 12 has a particular inherent stiffness.

The rail slat 1 preferably is provided with a perforation 5 in the contact region with the foam material 12 so that the injected sealing material can pass through the rail slat 1.

Foam strips 12 can be provided on both sides of the rail slat 1 or both rail slat surfaces 1*c* so that injection channels 2 are formed on both sides of the metal sheet 1. The two foam material strips 12 do not have to be in communication but a perforation 5 in the metal sheet 1 between the foam material strips allows a pressure compensation during injection of the sealing materials and makes it possible to select the cross-sectional surface or the thickness of the foam material strip to be smaller because a local functional restriction of a foam material strip 12 by the parallel extending channel can be compensated for on the other side of the metal sheet. The foam material strips 12 preferably are arranged centrally on the rail slat surfaces 1*c*.

It is ensured that the two water paths along the two rail slat surfaces 1*c* are—sealed off both by way of the provision of the perforation 5 and a single foam material strip as arrangement for forming an injection channel 2, as well as by providing two foam material strips 12.

The arrangement forming the injection channels 2 also can be arranged at one of the side longitudinal edges 1*a* of the rail slat 1, however in doing so the injection channel 2, which is formed, is located close to the wall surface so that the danger exists that the injection material emerges along a short path out of the wall so that no pressure can be built-up to ensure the tightness.

The rail slat 1 is a thin walled element, which can be made of plastics material or of metal. The connection between the foam strip 12 and the rail slat 1 preferably is produced by glueing.

The rail slat 1 is either a plate shaped element (FIGS. 1 and 2) or it also can be provided with a contour line (FIGS. 3 and 4), in order to receive the foam material strip 12 in it partially or completely. The rail slat 1 has a greater stiffness due to its contour line and offers a protection against the pressure of the wall on the adjacent abutting concrete against the wall 4 to the foam material, because the side flanks or the side surfaces 8 of the foam material and one of the two surfaces 9 of the foam material 12 extending parallel to the joint are surrounded by the metal sheet 1. The region of the metal sheet 1 surrounding the foam material 12 can have a perforation 5, which can be provided at one or at all three side walls surrounding the foam material 12.

The assembly of the predetermined crack joint rail in accordance with the invention is performed by applying the predetermined crack joint rail in a shuttering region of a wall to be concreted. The predetermined crack joint rail thereby is erected on the concrete slab, on which the wall is to be concreted, whereby the rail slat 1 stands substantially vertically to the side surfaces of the wall 4 to be concreted. After the concreting procedure the sealing material is injected into the sealing channel formed by the foam material strips 12, which then completely fills the predetermined crack joint formed during the curing procedure. The injection of the sealing material can then take place if a further section 11 is to be applied at the wall 4 with the predetermined crack joint rail, which section seals the injection channel 2 to above. The injection channel 2 is then drilled from the outside the sealing material is injected (FIG. 9) through the bore 10. If the foam material strip 12 terminates open to above, then an injection tube can be placed above at the foam material strip whereby the open end of the foam material strip 2 is to be sealed off about the injection tube so that the injection material can be injected under pressure.

The predetermined crack joint rail in accordance with the invention also can be used in advantageous manner together with a rail slat 1 and a foam material strip 12, applied thereto, in combination with a swelling strip 6 (FIGS. 5 and 6). The swelling strip 6 is to be applied at least on one side, preferably on both sides of the rail slat 1 or at the side longitudinal edge 1*a* of the rail slat 1 along the overall length of the rail slat. After completion, it is shown whether the swelling strip ensures the required tightness in the predetermined crack joint 7. If this is the case, then a subsequent injection of a sealing material need not be performed. If, however, subsequent non tightness should result, then by boring of the injection channel 2 sealing material can be injected at any time and the leaky predetermined crack joint can be sealed off. The subsequent injection of sealing material takes place by boring into the injection channel and by the injection of the sealing material. By using swelling strips thus no risks are created because subsequently the tightness can be re-created. This also allows the use of swelling strips with relatively smaller thickness, which in most cases provide sufficient tightness. Thus the costs of using relatively expensive swelling strips are held in limits, which, in combination with the foam material which is cost favorable in comparison to the swelling strip, provides an overall economic solution of the problem without that the risk of a non-tight predetermined crack joint exists, which subsequently cannot be sealed off.

The above described arrangements of the foam material strip 12, the arrangement of the foam material strips in relation to the swelling strips 6 or in relation to the perforation 5 simultaneously can be applied with other arrangements forming an injection channel 2.

A further advantageous embodiment is a rail slat 1, which has a hollow injection channel 2, which is surrounded completely by two side and one front and rear walls 16, 17, 18, 19 of the rail slat 1, and releases the sealing material via a perforation 5 to the outside (FIGS. 7 and 8). The hollow injection channel 2 can be filled either with a foam material strip 12 or the openings of the perforation 5 can be sealed off against the entry of concrete during the concreting procedure by a fleece or foam material or similar, which is pervious to the sealing material. The openings of the perforation 5 also can be applied on the side surfaces of the injection channel 2, whereby their arrangement and dimension can be selected according to the sealing material used and the concrete used. However, it is essential that sealing material can emerge on both sides of the rail slat 1 so that it is ensured that, by way of the injection procedure, the predetermined crack joint is fully sealed off.

A conventional injection tube also can be used as the arrangement forming the injection channel in place of a foam material strip. When using a conventional injection tube with circular cross-section, preferably two injection tubes are used on both sides of the rail slat or the holes of the perforation are formed as oblong holes so that care is taken to have sufficient throughflow of the sealing material through the rail slat.

If only a single injection tube 13 is applied at a rail slat 1 with perforation, then preferably also an injection tube can be used, which consists of a tubular section 14 and a strip shaped base 15, whereby the base 15 is applied on the region of the perforation 5 of the rail slat 1 (FIGS. 10 and 11). The base 15 is provided with exit openings for the sealing material. This is new as compared to conventional injection tubes with base strip, in which the base strip only serves as fixing element for easy application of the injection tube at the region to be sealed off. By way of such an arrangement it is ensured that the sealing material, which is injected into the injection tube 13, emerges both out of the tube into the concrete region surrounding the tube as well as via the base strip 15, which preferably consists of the same material as the tube section 14, and through the holes of the perforation 5 onto the other side of the rail slat 1 in order to seal off defective positions occurring there.

In FIG. 12 a further embodiment of the predetermined crack joint rail in accordance with the invention is shown in cross-section.

The rail slat 1 of this predetermined crack joint rail is symmetrically formed about a transverse central axis 20. The arrangement for forming an injection channel is located at the transverse center of the rail slat 1, which arrangement is sub-divided into three regions, a central hollow channel 2*a* and two side foam material strips 12, each of which forms respectively a partial region 2*b* of the injection channel. The hollow channel 2*a* has a rectangular cross-section and is limited by two side walls 21 and a roof and floor wall 22, 23. The side walls 21 are arranged spaced apart at a smaller distance from each other, which corresponds to about the material thickness of the metal sheet type material of the rail slat 1.

The roof and floor wall 22, 23 extends on both sides beyond the side walls 21, so that the roof and floor wall 22, 23 form grooves, together with the side walls 21, which grooves are open on the side, for receiving the foam material strips. Openings for a perforation 5 are provided in both side walls 21 so that the hollow channel 2*a* is in communication with the foam material strips 12. The openings can be arranged to be staggered in the side walls 21, so that the cross-section of the rail slat 1, shown in FIG. 12, extends only in the right hand side wall 21 through an opening of the perforation 5.

The rail slat 1 is provided with stiffening webs 24 for stiffening the predetermined crack joint rail, which webs are respectively formed by joining perpendicularly to the rail slat surfaces 1*c* and extend across the overall length of the rail slat 1.

The stiffening webs 24 also cause an extension of the water path in a predetermined crack, so that thereby not only the stiffness of the rail slat 1 is improved but also a better tightness is achieved.

I claim:

1. Predetermined crack joint rail for construction into a wall to be concreted, comprising a substantially strip shaped rail slat (1), an arrangement forming an injection channel (2) applied thereto, which extends along the length of the rail slat (1), the arrangement forming an injection channel having a contact region which contacts the rail slat, and the rail slat having a perforation (5) adjacent the contact region of the arrangement forming an injection channel (2), whereby injected sealing material is able to penetrate through the rail slat (1).

2. Predetermined crack joint rail according to claim 1, characterised thereby that the rail slat (1) has a perforation (5) in the region of the arrangement forming an injection channel (2).

3. Predetermined crack joint rail according to claim 1, characterized thereby that the rail slat (1) consists of a thin walled plastics material part.

4. Predetermined crack joint rail according to claim 1, characterized thereby that the rail slat (1) consists of a zinc sheet metal.

5. Predetermined crack joint rail according to claim 1, characterized thereby that a swelling strip (6) is provided extending at the rail slat (1) substantially parallel to the arrangement forming the one injection channel (2).

6. Predetermined crack joint rail according to one of the claims 1 to 5, characterised thereby that a swelling strip (6) is provided extending at the rail slat (1) substantially parallel to the arrangement forming the one injection channel (2).

7. Predetermined crack joint rail according to claim 5, characterized thereby that the swelling strip (6) is arranged adjacent to the arrangement forming the one injection channel (2).

8. Predetermined crack joint rail according to claim 5, characterized thereby that a swelling strip (6) is applied on both sides of the rail slat (1).

9. Predetermined crack joint rail according to claim 1, characterized thereby that a connection between the arrangement forming the one injection channel (2), and the rail slat (1) is glued.

10. Predetermined crack joint rail according to claim 1, characterized thereby that the arrangement forming the injection channel (2) is a foam material strip (12) of an open cell foam material.

11. Predetermined crack joint rail according to one or more of the claims 1 to 10, characterised thereby that the arrangement forming the injection channel (2) is a foam material strip (12) of an open cell foam material, which preferably consists of a stiff material.

12. Predetermined crack joint rail according to claim 11, characterised thereby that the rail slat (1) has a contour line in the region of the foam material strip 12, in which the foam material strip (12) is at least partially received.

13. Predetermined crack joint rail according to claim 1, characterized thereby that the arrangement forming the injection channel (2) is a hollow channel (2*a*) formed integrally at the rail slat (1).

14. Predetermined crack joint rail according to one or more of claims 1 to 10, characterised thereby that the arrangement forming the injection channel (2) is a hollow channel (2*a*) formed integrally at the rail slat (1).

15. Predetermined crack joint rail according to claim 1, characterized thereby that the arrangement forming the injection channel (2) is an injection tube (13).

16. Predetermined crack joint rail according to one or more of the claims 1 to 10, characterised thereby that the arrangement forming the injection channel (2) is an injection tube (13).

17. Predetermined crack joint rail according to claim 1, characterized thereby that the rail slat (1) consists of a thin walled inherently stiff material.

18. Predetermined crack joint rail according to claim 1, characterized thereby that the arrangement for forming an injection channel (2) is arranged transversely centrally at the rail slat (1).

19. Use of a predetermined crack joint rail according to claim 1, characterized thereby that the predetermined crack joint rail is introduced into a region of the wall to be concreted and extends along the overall height of the wall, and that, after concreting the wall, sealing material is injected into the injection channel (2) formed.

20. Use of a predetermined crack joint rail according to one or more of the claims 1 to 19, characterised thereby that the predetermined crack joint rail is introduced into a region of the wall to be concreted and extends along the overall height of the wall, and that, after concreting the wall, sealing material is injected into the injection channel (2) formed.

21. Predetermined crack joint rail according to claim 6 characterized thereby that the connection between the swelling strip (6) and the rail slat (1) is glued.

* * * * *